US010033143B1

(12) United States Patent
Giordano et al.

(10) Patent No.: US 10,033,143 B1
(45) Date of Patent: Jul. 24, 2018

(54) MIRROR TAP POWER CORD KIT

(71) Applicants: Michael A. Giordano, Rohnert Park, CA (US); Sebastien Jame, Sebastopol, CA (US)

(72) Inventors: Michael A. Giordano, Rohnert Park, CA (US); Sebastien Jame, Sebastopol, CA (US)

(73) Assignee: J28 Design, Inc., Cotati, CA (US)

( * ) Notice: Subject to any disclaimer, the term of this patent is extended or adjusted under 35 U.S.C. 154(b) by 0 days.

(21) Appl. No.: 15/277,197

(22) Filed: Sep. 27, 2016

(51) Int. Cl.

| | |
|---|---|
| ***H01R 24/28*** | (2011.01) |
| ***H01R 31/06*** | (2006.01) |
| ***H01R 24/38*** | (2011.01) |
| ***H01R 24/62*** | (2011.01) |
| ***H01R 13/652*** | (2006.01) |
| *H01R 103/00* | (2006.01) |
| *H01R 107/00* | (2006.01) |

(52) U.S. Cl.
CPC ..... *H01R 24/28* (2013.01); *H01R 13/652* (2013.01); *H01R 24/38* (2013.01); *H01R 24/62* (2013.01); *H01R 2103/00* (2013.01); *H01R 2107/00* (2013.01)

(58) Field of Classification Search
CPC ..... H01R 24/28; H01R 24/38; H01R 24/62; H01R 31/06; H01R 31/062
See application file for complete search history.

(56) References Cited

U.S. PATENT DOCUMENTS

| | | | | | |
|---|---|---|---|---|---|
| 3,761,862 | A * | 9/1973 | Spiteri | F21L 14/00 | 439/505 |
| 4,787,862 | A * | 11/1988 | Lee | H01R 29/00 | 439/502 |
| 4,900,270 | A * | 2/1990 | Edwards | H01R 31/06 | 439/173 |
| 4,946,396 | A * | 8/1990 | Saitoh | A63H 29/22 | 439/500 |
| 5,775,939 | A * | 7/1998 | Brown | G06F 1/266 | 439/502 |
| 5,961,207 | A * | 10/1999 | Petkovic | F21L 14/02 | 362/376 |

(Continued)

*Primary Examiner* — Briggitte R Hammond
(74) *Attorney, Agent, or Firm* — Bay Area Technology Law Group PC

(57) ABSTRACT

A kit for powering an aftermarket device from a wiring harness made available to the interior of a vehicle, the wiring harness connector comprising a 12 V port and a ground port, both accessible to a user. The kit includes a power cord having a first end and a second end, the first end having a pair of first end connectors and the second end terminating in a plug for powering the user-selected aftermarket device. The power cord further includes a length of two power cord wires, a first power cord wire for carrying current from a 12 V source from the wiring harness and a second power cord wire establishing a ground connection between the wiring harness and aftermarket device. The kit includes at least first and second jumper pairs, the jumper pairs having first jumper pair ends and second jumper pair ends, the first jumper pair ends being configured to interface with the pair of first end connectors for establishing contact with the two power cord wires and the second jumper ends being male connectors wherein the male connectors of the first jumper pair differ in size from the male connectors of the second jumper pair.

15 Claims, 3 Drawing Sheets

(56) References Cited

U.S. PATENT DOCUMENTS 6,190,385 B1 * 2/2001 Tom ..... A61B 18/14 439/502
6,461,192 B1 * 10/2002 Kwoka ..... H01R 31/06 439/505
6,608,264 B1 * 8/2003 Fouladpour ..... H01R 29/00 200/51.03
6,909,907 B1 * 6/2005 Oyang ..... G01C 21/26 342/357.75
7,033,209 B2 * 4/2006 Swiatek ..... B62J 99/00 439/502
7,123,475 B2 * 10/2006 Park ..... G06F 1/1632 361/679.41
7,488,187 B2 * 2/2009 Wolf ..... H01R 31/005 439/106
7,798,845 B1 * 9/2010 Buchanan ..... H01R 23/27 439/502
7,976,337 B1 * 7/2011 Cortopassi ..... G06F 1/1632 439/502
8,038,931 B1 * 10/2011 Thomas ..... H05B 6/101 219/632
8,172,603 B1 * 5/2012 Richardet, Jr. ..... H01R 11/24 439/504
2009/0091292 A1 * 4/2009 Nippear ..... H02J 7/0045 320/111
2009/0230783 A1 * 9/2009 Weed ..... H02J 7/355 307/150
2010/0097057 A1 * 4/2010 Karpen ..... G01N 21/8806 324/238
2011/0062913 A1 * 3/2011 Lin ..... H02J 7/0055 320/101
2012/0028508 A1 * 2/2012 Johnston ..... A61H 33/6063 439/668
2014/0139175 A1 * 5/2014 Gonzalez ..... F02N 11/12 320/101

* cited by examiner

MIRROR TAP POWER CORD KIT

TECHNICAL FIELD

The present invention involves a kit for powering an aftermarket device from a power source available to the interior of a vehicle such as from an automotive automatic dimming mirror, powered sunroof or map light. For the sake of simplicity, reference will only be made to automotive automatic dimming mirrors throughout this specification. Automotive automatic dimming mirrors are provided with wiring harnesses which are terminated with a connector which consists of multiple ports including a 12 V port and ground port both accessible to a user. The present kit enables a user to power an aftermarket device such as a radar detector from the wiring harness connector of the automotive automatic dimming mirror in kit form to enable an electrical connection be made between the wiring harness and aftermarket device recognizing that the ports within the connector can differ in size and thus make it difficult for a single power cord to function with all available automotive automatic dimming mirrors.

BACKGROUND OF THE INVENTION

Most modern vehicles employ automatic dimming mirrors as standard equipment. It is been recognized that these devices increase driving safety by eliminating glare that can impair vision. Such devices generally employ a forward looking sensor that detects low ambient light from headlights behind the vehicle and directs the rearview sensor to look for glare. The mirror darkens automatically in proportion to how bright the glare is and then clears once the glare is no longer detected. This technology, called electrochromics applies electricity in order to tint glass through a low-voltage power supply. Electricity moves through the electrochromic gel placed between two pieces of glass during manufacture which have been treated with an electrically conductive coating.

In order to function, automatic dimming mirrors must be powered. They generally draw power from the 12 V battery that the vehicle employs for its general automotive use. All such mirrors also make a wiring harness available to a user either by directly exposing the wiring harness connector or by including the wiring harness connector within the outer plastic shell of the mirror or the connector between the mirror and its supporting substructure.

The vast majority of drivers are increasingly making use of aftermarket devices which require electrical power to enable them to function. Although many of such devices run on battery power, the better solution is to employ an external power source to avoid loss of functionality as batteries degrade over time. The most ideal power source is, again, the 12 V supply also generated from the automotive battery. Unfortunately, unless care is taken to establish the appropriate electrical connection between the 12 V power supply and aftermarket device, a user is faced with unsightly power lines generally established from the typical cigarette lighter outlet or as a result of running a power cord from the interior of the vehicle into the engine compartment and directly to the 12 V source.

A solution to this dilemma has been to employ a relatively short power cord having, at one end, a plug for interfacing with the aftermarket device and the other end having a pair of male connectors for joining with the female ports of the mirror's wiring harness connector. Unfortunately, however, mirror wiring harness connectors are devoid of any established sizing standard such that a user does not know whether the male connectors of his or her power cord will be appropriately sized to be received and frictionally retained by the ports of the wiring harness connector in his or her vehicle.

It is thus an object of the present invention to provide a kit for powering an aftermarket device from a wiring harness connector available to the interior of a vehicle such as an automatic dimming mirror harness which is capable of successfully addressing the obstacles preventing its universal adoption.

It is yet a further object to the present invention to provide a kit for powering an aftermarket device capable of being used with a wiring harness connector available to the interior of a vehicle such as automatic dimming mirror harness connectors with ports of varying sizes.

These and further objects be more readily apparent when considering the following disclosure and appended claims.

SUMMARY OF THE INVENTION

A kit for powering an aftermarket device from a wiring harness connector available to the interior of a vehicle such as one associated with an automotive automatic dimming mirror. Such a wiring harness connector comprising a 12 V port and a ground port, both accessible to a user, said kit comprising a power cord, said power cord comprising a first end and a second end, said first end comprising a pair of first end connectors and said second end comprising a plug for powering said aftermarket device, said power cord further comprising a length of two power cord wires, a first power cord wire for carrying current from a 12 V source from said wiring harness connector and a second power cord wire establishing a ground connection between said wiring harness connector and aftermarket device and at least first and second jumper pairs, said jumper pairs comprising first jumper pair ends and second jumper pair ends, said first jumper pair ends being configured to interface with said pair of first end connectors for establishing contact with said two power cord wires and wherein said second jumper pair ends comprise male connectors wherein the male connectors of the first jumper pair differ in size from the male connectors of the second jumper pair.

A kit for powering an aftermarket device from a wiring harness connector available to the interior of a vehicle such as one associated with an automotive automatic dimming mirror. Such a wiring harness connector comprising a 12 V port and a ground port, both accessible to a user, said kit comprising a power cord, said power cord comprising a first end and a second end, said first end comprising a pair of female connectors and said second end comprising a plug for powering said aftermarket device, said power cord further comprising a length of two power cord wires, a first power cord wire for carrying current from a 12 V source from said wiring harness connector and a second power cord wire establishing a ground connection between said wiring harness connector and aftermarket device and at least first and second jumper pairs, each jumper pair comprising a first pair of male connectors sized to be received by said first end of said power cord and a second pair of male connectors wherein the second male connector of said first jumper pair differs in size from the second male connector of the second jumper pair.

DETAILED DESCRIPTION OF THE INVENTION

Figure 1:
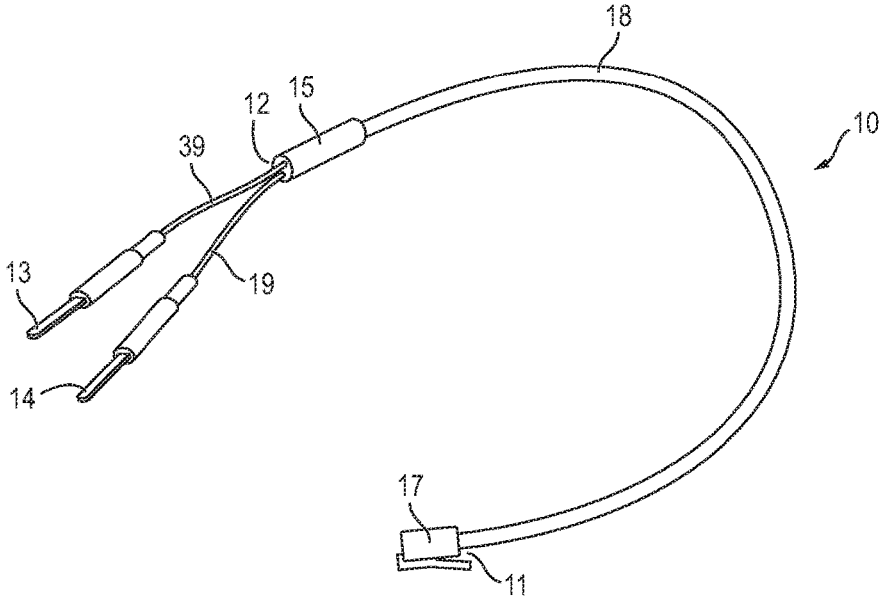
FIG. 1 (PRIOR ART)
FIG. 1 is a plan view of a power cord of the prior art to which the present invention is an improvement.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, power cord 10 is depicted which typifies products of the prior art. In this example, a pair of 24 AWG wires 19 and 39 are paired within outer sheath 18 resulting in power cords typically of standard 9", 12", 15", 20" and 36" lengths. At one end 12 of power cord 10, wires 19 and 39 extend from sheath 18 terminating in male connectors 13 and 14 for insertion within the appropriate wiring harness connector of an automotive automatic dimming mirror. In doing so, male connectors 13 supplies current from the automotive 12 V battery while connector 14 creates a ground connection. For safety, a 2 amp inline fuse is inserted at 15 along wire 39 which carries the 12 V power from the battery. At end 11 of power cord 10 is located a suitable plug for powering an aftermarket device. In this illustration, plug 17 is in the form of an RJ-11 connector which is compatible with most radar detectors currently on the market.

Although power cord assembly 10 of FIG. 1 enables a user to cleanly power an aftermarket device from the electrical system of the automobile through the wiring harness of a typical automotive automatic dimming mirror while minimizing the need for unsightly wires, it is been recognized that the lack of consistency of the size of the ports within the harness connectors results in the power cord of FIG. 1 being incapable of use in all environments. Users can be frustrated for it is difficult to foresee in advance of an attempted installation whether the standard power cord will be frictionally received within the wiring harness connector of the vehicle in which the aftermarket accessory is to be powered.

Figure 2:
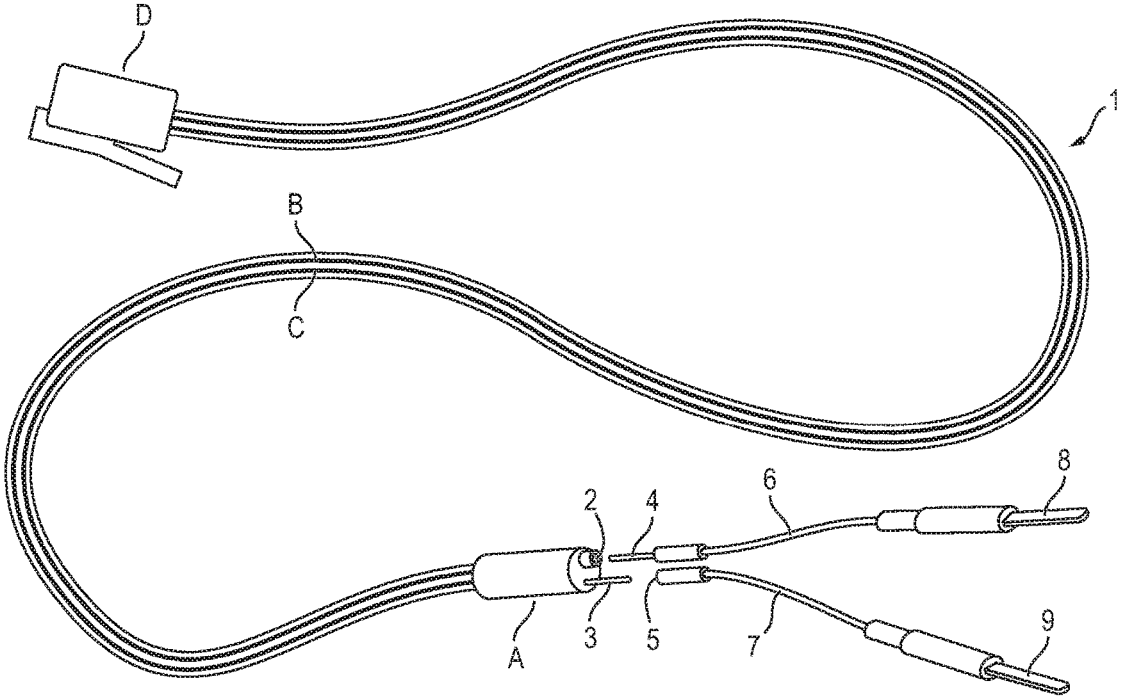
FIG. 2 is a perspective view of a power cord of a first embodiment of the present invention as well as a pair of jumpers for use therewith.
Figure 3:
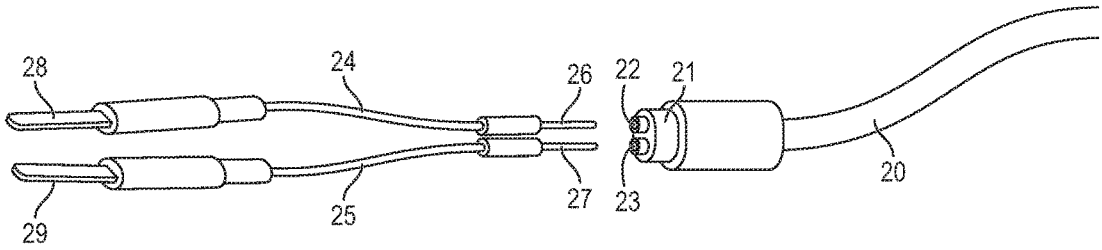
FIG. 3 is a perspective view of a terminal end of a power cord of a second embodiment of the present invention as well as a pair of jumpers for use therewith.
Figure 4A:
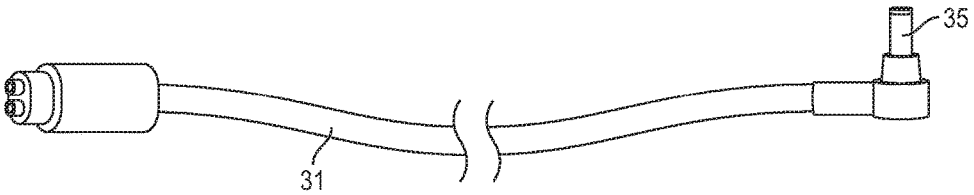
FIG. 4 is a plan view of examples of power cords of the present invention with various plugs for powering aftermarket devices contemplated for use herein.
Figure 4B:
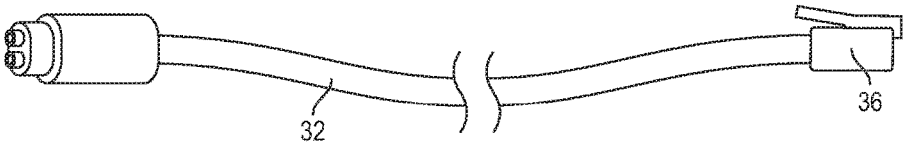
Figure 4C:
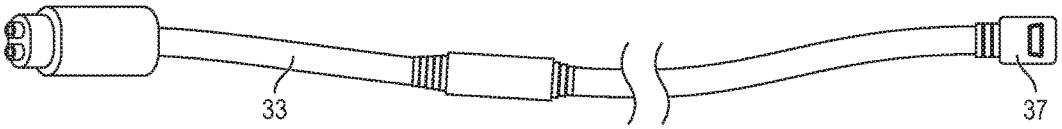
Figure 4D:
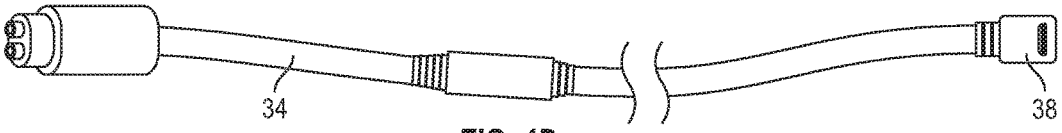

The solution to this problem can be readily appreciated in reference to FIGS. 2, 3 and 4.

Turning first to FIG. 2, power cord 1 at terminal end "A" is provided with first end connectors 2 and 3 and at second terminal end plug "D" for powering said aftermarket device, examples of which are illustrated in FIG. 4. Power cord 1 further comprises a length of two power cord wires "B" and "C" a first power cord wire for carrying current from a 12 V source from the wiring harness and a second power cord wire establishing a ground connection between the wiring harness and aftermarket device through plug "D." Although the present kit is provided with multiple jumper pairs, for sake of simplicity, only jumper pair 6 and 7 is included in this illustration. Instead of jumper pair 6 and 7 being hardwired to power cord 1, each jumper pair comprises first jumper ends 4 and 5 and second jumper ends 8 and 9, the first jumper ends 4 and 5 being configured to interface with first end connectors 2 and 3 while second jumper ends 8 and 9 comprise male connectors. As noted, it is contemplated that the kit employs at least two pairs of jumpers wherein the male connectors of the first jumper pair (as shown) differ in size from the male connectors of the second jumper pair (not shown). It should further be noted that in the illustrated example of FIG. 2, wire "C" carrying the 12 V current is terminated by female connector 2 while first end connector 3 is a male connector. As such, jumper end 4 is a male connector while jumper end 5 is a female connector.

FIG. 3 illustrates a second embodiment of the present invention in which power cord 20 at terminal end 21 is provided with female connectors 22 and 23. Instead of jumpers 24 and 25 being hardwired to power cord 20, each jumper comprises a first pair of male connectors 26 and 27 sized to be received by first end 21 of power cord 20 within female connectors 22 and 23. Jumpers 24 and 25 terminate in male connectors 28 and 29 to be received by a suitable wiring harness of an automotive automatic dimming mirror such as that depicted in FIG. 6. The kit of the present invention is intended to be supplied with a plurality of jumpers each of which comprises a first pair of male connectors of standard size to be received by first end 21 of power cord 20 and at least a second pair of male connectors of differing size to accommodate wiring harness connectors, again, of a different size. Two of such jumper pairs are shown in FIG. 5.

Figure 5:
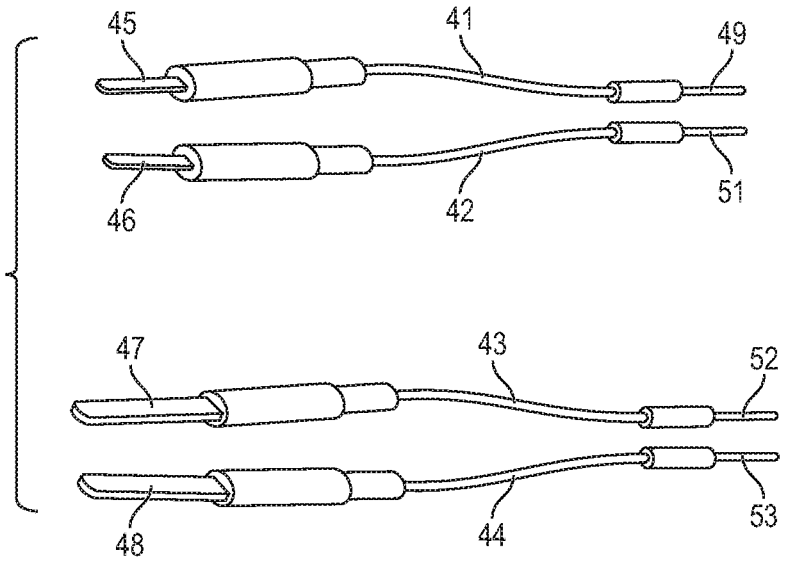
FIG. 5 is a plan view of two sets of jumper cables illustrating their various sizes for use with appropriate automotive automatic dimming mirror wiring harnesses.

In turning to FIG. 5, first set of jumper pairs 41 and 42 and second set of jumper pairs 43 and 44 are shown to illustrate the essence of the present invention. It is contemplated that, in each instance, first pair of male connectors 49/51 and 52/53 are all of the same size for being frictionally received by female connectors 22 and 23 (FIG. 3). However, second pair of male connectors 45/46 differs in size from second pair of male connectors 47/48, again, to accommodate various wiring harness connector ports which are of different sizes. Thus, the present kit is provided with a power cord having a first end and a second end, the first end comprising a pair of first end connectors and a second end comprising a plug for powering the typical aftermarket device. The power cord comprises a length of two power cord wires, a first for carrying current from a 12 V source from a wiring harness and a second for establishing a ground connection between the wiring harness connector and aftermarket device and at least first and second jumper pairs, each jumper pair comprising first jumper pair ends and second jumper pair ends, said first jumper pair ends configured to interface with said pair of first end connectors for establishing contact with said two power cord wires and wherein said second jumper ends comprise male connectors wherein the second male connector of the first jumper pair differs in size from the second male connector of the second jumper pair.

Figure 6:
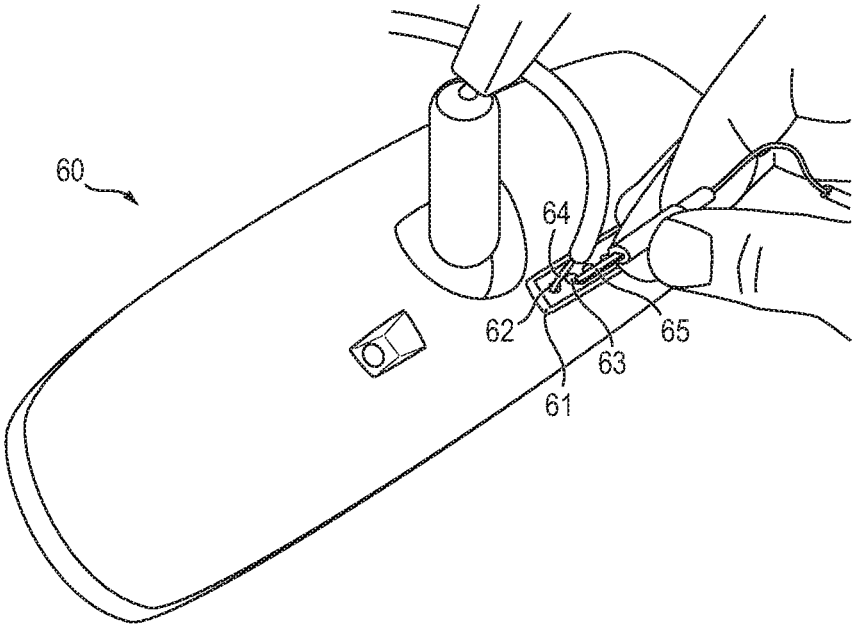
FIG. 6 is a perspective view illustrating the typical automotive automatic dimming mirror with an exposed wiring harness connector for receipt of the power cord of the present invention.

In turning to FIG. 6, one can be seen how wiring harness connector 61 including female ports 62 and 63 can be employed by the insertion of male prongs 64 and 65 for powering a suitable aftermarket device.

Referring to FIG. 4, examples of typical power cords 31, 32, 33 and 34 are shown with examples of typical plugs for powering such devices. These include DC plug 35, RJ-11 plug 36, mini USB plug 37 and micro USB plug 38. Through the proper selection of a suitable plug, one can employ the present invention to power such diverse aftermarket devices such as radar detectors, smart phones, tablets, media players and other and similar devices commonly enjoyed by drivers to lessen the burden of their commute.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A kit for powering an aftermarket device from an automotive automatic dimming mirror, said automotive automatic dimming mirror having a wiring harness connector comprising a 12 V port and a ground port, both accessible to a user, said kit comprising a power cord, said power cord comprising a first end and a second end, said first end comprising a pair of first end connectors and said second end comprising a plug for powering said aftermarket device, said power cord further comprising a length of two power cord wires, a first power cord wire for carrying current from a 12 V source from said wiring harness and a second power cord wire establishing a ground connection between said wiring harness and aftermarket device and at least first and second jumper pairs, said jumper pairs comprising first jumper pair ends and second jumper pair ends, said first jumper pair ends being configured to interface with said pair of first end connectors for establishing contact with said two power cord wires and wherein said second jumper ends comprise male connectors wherein the male connectors of the first jumper pair differ in size from the male connectors of the second jumper pair.

2. The kit of claim 1 wherein the first jumper pair ends comprise both male and female connectors.

3. The kit of claim 1 wherein said first end connectors of said power cord comprise a female connector to said power cord wire for carrying current from said 12 V source and a male connector to said power cord wire establishing said ground connection between said wiring harness and aftermarket device.

4. The kit of claim 1 further comprising a fuse positioned across said first power cord wire.

5. The kit of claim 1 wherein said plug for powering said aftermarket device comprises a DC plug.

6. The kit of claim 1 wherein said plug for powering said aftermarket device comprises an RJ-11 plug.

7. The kit of claim 1 wherein said plug for powering said aftermarket device comprises a mini USB plug.

8. The kit of claim 1 wherein said plug for powering said aftermarket device comprises a micro USB plug.

9. A kit for powering an aftermarket device from an automotive automatic dimming mirror, said automotive automatic dimming mirror having a wiring harness connector comprising a 12 V port and a ground port, both accessible to a user, said kit comprising a power cord, said power cord comprising a first end and a second end, said first end comprising a pair of female connectors and said second end comprising a plug for powering said aftermarket device, said power cord further comprising a length of two power cord wires, a first power cord wire for carrying current from a 12 V source from said wiring harness and a second power cord wire establishing a ground connection between said wiring harness and aftermarket device and at least first and second jumper pairs, each jumper pair comprising a first pair of male connectors sized to be received by said first end of said power cord and a second pair of male connectors wherein the second male connector of said first jumper pair differs in size from the second male connectors of the second jumper pair.

10. The kit of claim 9 further comprising a fuse positioned across said first power cord wire.

11. The kit of claim 9 wherein said plug for powering said aftermarket device comprises a DC plug.

12. The kit of claim 9 wherein said plug for powering said aftermarket device comprises an RJ-11 plug.

13. The kit of claim 9 wherein said plug for powering said aftermarket device comprises a mini USB plug.

14. The kit of claim 9 wherein said plug for powering, said aftermarket device comprises a micro USB plug.

15. A kit for powering an aftermarket device from a wiring harness connector made available to the interior of a vehicle, said wiring harness connector comprising a 12 V port and a ground port, both accessible to a user, said kit comprising a power cord, said power cord comprising a first end and a second end, said first end comprising a pair of first end connectors and said second end comprising a plug for powering said aftermarket device, said power cord further comprising a length of two power cord wires, a first power cord wire for carrying current from a 12 V source from said wiring harness and a second power cord wire establishing a ground connection between said wiring harness and aftermarket device and at least first and second jumper pairs, said jumper pairs comprising first jumper pair ends and second jumper pair ends, said first jumper pair ends being configured to interface with said pair of first end connectors for establishing contact with said two power cord wires and wherein said second jumper ends comprise male connectors wherein the male connectors of the first jumper pair differ in size from the male connectors of the second jumper pair.

* * * * *